US008915333B2

(12) United States Patent
Hoerler

(10) Patent No.: US 8,915,333 B2
(45) Date of Patent: Dec. 23, 2014

(54) ELEVATOR

(75) Inventor: Marco Hoerler, Gordola (CH)

(73) Assignee: KONE Corporation, Helsinki (FI)

( * ) Notice: Subject to any disclaimer, the term of this patent is extended or adjusted under 35 U.S.C. 154(b) by 531 days.

(21) Appl. No.: 12/669,708

(22) PCT Filed: Sep. 23, 2009

(86) PCT No.: PCT/EP2009/062341
§ 371 (c)(1),
(2), (4) Date: Jan. 19, 2010

(87) PCT Pub. No.: WO2010/037679
PCT Pub. Date: Apr. 8, 2010

(65) Prior Publication Data

US 2012/0103730 A1 May 3, 2012

(30) Foreign Application Priority Data

| | | |
|---|---|---|
| Sep. 30, 2008 | (CH) | 1550/08 |
| Jul. 24, 2009 | (CH) | 1171/09 |
| Jul. 30, 2009 | (CH) | 1192/09 |
| Sep. 21, 2009 | (CH) | 1457/09 |

(51) Int. Cl.
*B66B 11/08* (2006.01)
*B66B 11/00* (2006.01)

(52) U.S. Cl.
CPC ..... *B66B 11/008* (2013.01); *B66B 11/007* (2013.01); *B66B 11/0085* (2013.01)
USPC ..... 187/255; 187/251; 187/254; 187/256

(58) Field of Classification Search
CPC ..... B66B 11/08; B66B 11/007; D07B 1/22; D07B 2201/2087; D07B 2501/2007
USPC ..... 187/255, 251, 254, 256, 260, 262, 266
See application file for complete search history.

(56) References Cited

U.S. PATENT DOCUMENTS

| | | | | |
|---|---|---|---|---|
| 373,114 | A * | 11/1887 | Wallmann | 187/266 |
| 635,454 | A * | 10/1899 | Wheaton | 187/258 |
| 4,981,462 | A * | 1/1991 | White et al. | 474/238 |
| 5,490,579 | A * | 2/1996 | Ratcliffe et al. | 187/266 |
| 6,776,263 | B2 * | 8/2004 | Gottlieb et al. | 187/251 |
| 7,222,697 | B2 * | 5/2007 | Chen | 187/263 |
| 7,562,744 | B2 * | 7/2009 | Mustalahti et al. | 187/254 |
| 7,757,817 | B2 * | 7/2010 | Ach | 187/251 |

(Continued)

FOREIGN PATENT DOCUMENTS

| | | |
|---|---|---|
| DE | 10 2006 005948 | 10/2007 |
| EP | 1 947 048 | 7/2008 |
| WO | 2008/056026 | 5/2008 |

*Primary Examiner* — William A Rivera
*Assistant Examiner* — Michael Riegelman
(74) *Attorney, Agent, or Firm* — Lucas & Mercanti, LLP

(57) ABSTRACT

An elevator comprising a cabin (1), vertical guide elements (2, 3) for guiding said cabin, at least one suspension or support belt (4, 5), groups of pulleys associated to the guide elements and the cabin; each of said groups of pulleys is composed of at least two coplanar pulleys arranged on parallel axles and vertically one above the other; each of the groups of pulleys comprises pulleys having a diameter decreasing from a pulley of a maximum diameter to a pulley of a minimum diameter. Preferred embodiments of the belts having one or two concave or convex surfaces and internal reinforcing wires are disclosed.

25 Claims, 12 Drawing Sheets

(56) References Cited

U.S. PATENT DOCUMENTS 7,806,238 B2 * 10/2010 Fischer ..... 187/266
7,971,687 B2 * 7/2011 Alves et al. ..... 187/251
2003/0069101 A1 * 4/2003 Pitts et al. ..... 474/260
2005/0217944 A1 * 10/2005 Aulanko et al. ..... 187/266
2006/0201749 A1 * 9/2006 Chen ..... 187/263

* cited by examiner

ELEVATOR

This application is a USC §371 national phase application of PCT/EP2009/062341 filed on Sep. 23, 2009, which claims priority to and the benefit of Swiss Patent Application No. CH 1550/08, filed Sep. 30, 2008; Swiss Patent Application No. CH 1171/09, filed Jul. 24, 2009; Swiss Patent Application No. CH 1192/09, filed Jul. 30, 2009 and Swiss Patent Application No. CH 1457, filed Sep. 21, 2009, the contents of which are incorporated herein by reference.

FIELD OF THE INVENTION

The present invention concerns an elevator as defined in the preamble of claim 1.

PRIOR ART

Said elevator has a self-supporting construction, being essentially supported by the vertical guide elements of the cabin. The elevator remains independent of the structure of the house, with significant cost advantages.

Said elevator can operate with or without a counterweight and is used particularly in family homes, usually for serving a small number of people and with a lifting capacity limited to few persons. It nevertheless represents a very large field of application comprising new buildings under construction as well as renovation of existing buildings to meet nowadays requirements of comfort. Hence, there is the need to offer the possibility to install an elevator in buildings that were not originally planned for this purpose, and without requiring costly and invasive transformations to the building.

WO 2008/056026 discloses an elevator provided with supporting cords on one side of the cabin guided by rails situated at the side of the cabin, comprising a plurality of groups of pulleys, each group in turn comprising a plurality of pulleys.

The plurality of pulleys arranged in each group of pulleys is intended to correspondingly reduce—according to the well known principle of multiple pulleys or sheaves—the power required for lifting the cabin. This arrangement is useful where no counterweight is installed, allowing a "lifting by friction" without compensation for the weight of the cabin. The cited prior art discloses that the pulleys of each group of pulleys are arranged coaxially, i.e. they are supported on one single axle, one next to the other. This solution has the advantage that less space is taken in vertical direction, as all the pulleys of one group of pulleys are located at the same level. On the other hand, it has the considerable drawback that belts cannot be used as a support means, because belts passing from one pulley of a group to the next do not permit lateral deviations, or require particular assisting elements (such as guide elements, etc.). This problem can be solved using cords and pulleys with large grooves, but on the other hand the cords require pulleys with a very large diameter. There are legal regulations specifying for example that the diameter of the pulleys must be equal to a multiple (30, 40 times) of the diameter of a steel cord.

A further disadvantage of coaxially arranged pulleys is that they generate an overturning momentum on the cabin, which results in major abrasion on the guide elements and increase of the traction power.

SUMMARY OF THE INVENTION

The present invention is aimed at overcoming the above problems and disadvantages of the prior art.

These aims are reached by an elevator with groups of coplanar pulleys having a decreasing diameter, according to independent claim 1. Preferred embodiments are disclosed in the dependent claims.

In one of the various embodiments of the invention, one suspension belt is arranged in the symmetry plane of one of the lateral walls or back wall of the cabin. In another embodiment, two support belts are arranged symmetrically on one of the side walls or the back wall of the cabin.

Each of the groups of pulleys can be composed of any number of vertically aligned pulleys, with a diameter progressively decreasing from a first larger pulley to a last and smaller pulley. In common embodiments of the invention, each group is composed of two or three pulleys. At least one of the pulleys is driven by a suitable motor. In some embodiments, a disc-like motor can be used to save space.

Particularly preferred embodiments of the invention relate to preferred form of the belt or belts of the cabin.

According to a first of said embodiments, the elevator comprises one or more flat belt(s) to drive the cabin, and the pulleys have correspondingly a groove for a flat belt.

According to another embodiment, the elevator comprises one or more belts with an arcuate cross section. A preferred form of an arcuate cross section belt is disclosed in detail in the priority application CH 1192/09, the content of which is incorporated herein by reference. The belt has a concave face and an opposite convex face, one of said concave and convex face being in contact with said pulleys. The pulleys having a contact surface which is correspondingly convex or concave, to engage the concave or convex face of the belt. The concave and convex faces of the belt are preferably parallel.

According to still a further embodiment, the elevator comprises one or more belt(s) with one flat face and an opposite convex or concave working surface. The working surface is in contact with the pulleys and the pulleys have correspondingly a concave or convex surface to engage the working surface of the belt. A preferred embodiment is discloses in detail in the priority application CH 1457/09, the content of which is incorporated herein by reference.

Preferably the belt or belts of the elevator are reinforced with a plurality of internal wires, made of appropriate material with a high resistance to traction. In a belt with an arcuate cross section, the reinforcing wires are preferably arranged on a plane parallel to the convex and concave opposite surfaces. In the embodiment where the belt (or belts) has one flat surface and an opposite concave or convex working surface, the reinforcing wires are preferably arranged on a plane parallel to the flat surface. The wires are for example steel wires having a diameter between 0.5 and 3 mm and distanced each other by 1 to 5 mm, preferably 2-3 mm. Reinforcing with internal wires is applicable to all the above disclosed embodiments of the belt or belts.

In further embodiments, the belts and the pulleys are equipped with respective means to increase the friction. In some embodiments, for example, the belt is toothed and the pulleys have corresponding teeth adapted to engage the toothed belt. Said teeth or equivalent means to increase the friction are applicable to flat belts as well as to belts with one or two concave or convex surfaces, as above disclosed.

The invention permits application of pulleys of minimum diameter, requiring less lateral space and keeping all the functional advantages of belts over steel cords, in particular if applied in elevators without counterweight, which in the known art depend on the friction exerted onto the rope of the driving pulley for correct movement.

The coplanar pulleys placed on mutually parallel axes, located one above the other vertically, and of diminishing diameters, allow to obtain a course of the belt adapted to reduce the power requirements by a factor of 4, 6 or more. The reduction of power requirements is obtained with the adoption of 2, 3 pulleys per group, etc. in such manner that the single parallel vertical tracts of the belt are not contacting each other, and that the belt does not undergo any lateral deviation. The invention provides a higher coefficient of friction and the possibility of applying smaller pulleys without requiring lateral guide elements for the belt, which moves always in the same plane and do not induce any lateral excursion of the cabin. Further advantages are the silent and vibration-free operation.

The invention is applicable to various elevators with or without counterweight. Embodiments with no counterweight are preferred as they make full use of all the advantages such as higher friction properties on the belt, but application to elevators with a counterweight is also possible.

The advantages of the invention, thanks to the fact that the belts are applied in arrangements requiring a minimum of space, and with a higher factor of reduction of the drive power required, allow realisation of elevators with or without counterweight under conditions of scarce availability of space, at limited cost, and securing efficient and reliable operation.

The advantages of the preferred belts with one or two convex/concave surface will be discussed with the help of the examples in the detailed description.

These and other advantages of the invention will be elucidated hereinbelow with reference to preferred and non-limiting embodiments.

DETAILED DESCRIPTION

A list of the elements in FIGS. 1 to 5 is reported hereinbelow.

Figure 1:
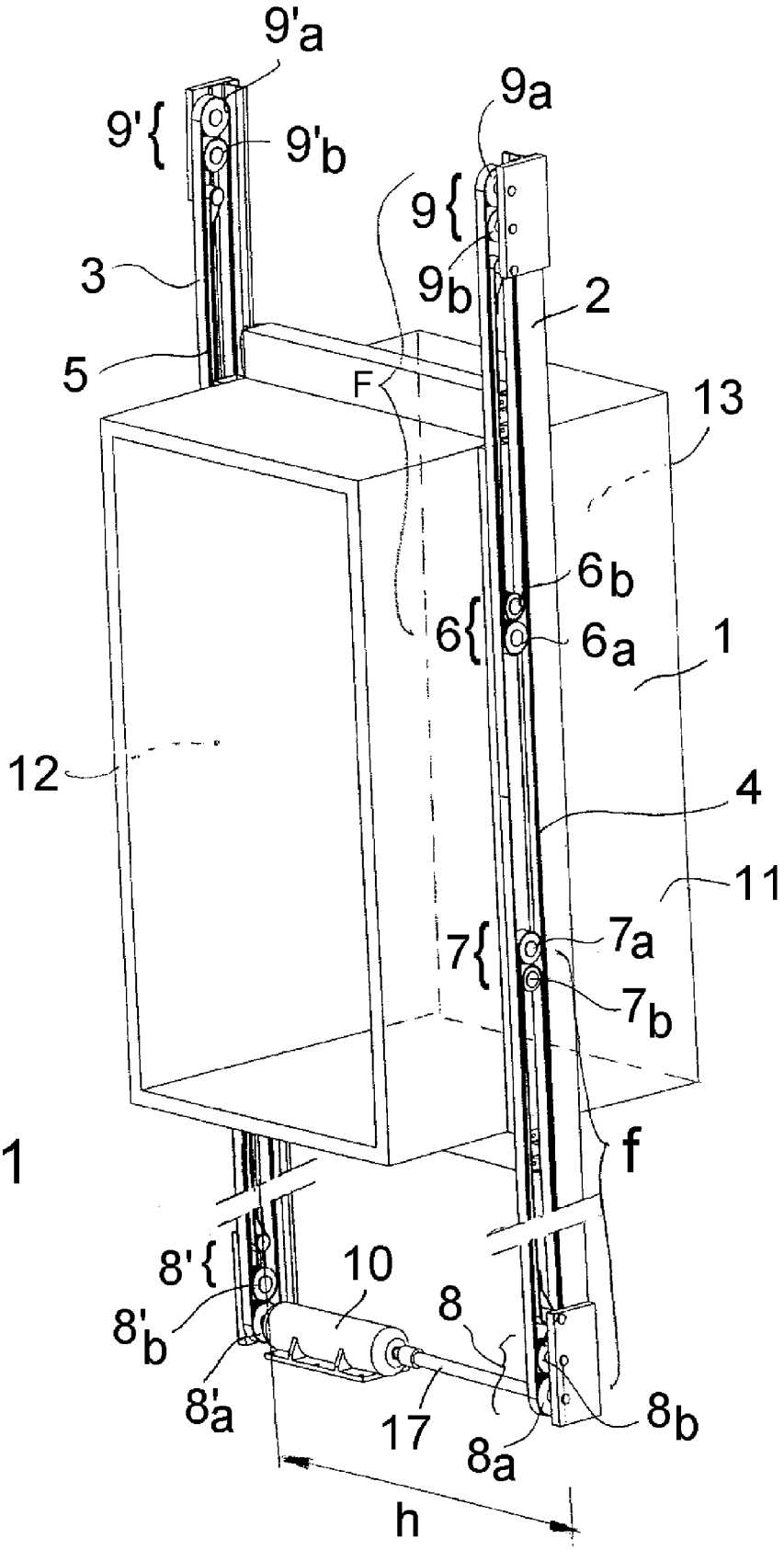
FIG. 1 is a sketch of an elevator with no counterweight according to one embodiment of the invention, with two belts applied on the sides of the cabin.

1 cabin
2 lateral guide element
3 lateral guide element
4 support belt
5 support belt
6 group of pulleys (6*a*, 6*b*, 6*c*; 6'*a*, 6'*b*, 6'*c*)
7 group of pulleys (7*a*, 7*b*, 7*c*; 7'*a*, 7'*b*, 7'*c*)
8 group of pulleys (8*a*, 8*b*, 8*c*; 8'*a*, 8'*b*, 8'*c*)
9 group of pulleys (9*a*, 9*b*, 9*c*; 9'*a*, 9'*b*, 9'*c*)
10 motor (motor with reduction gear)
11 lateral wall
12 lateral wall
13 back wall of the cabin
14 tensioning mechanism
15 transversal element
16 transversal element
17 horizontal axle
18 fixation pin
19 support plates FIG. 1 discloses an elevator with a cabin 1 which is guided on two vertical guides 2 and 3 and is provided with two suspension and support belts passing around groups of coplanar pulleys. In the example, a first belt 4 passes around four groups of pulleys 6 to 9, and a second belt 5 passes around another four groups of pulleys 6' to 9'.

The groups 6' and 7' are opposite to groups 6, 7 and are hidden behind the cabin 1 in FIG. 1.

Two of these groups, namely the groups 6, 7 and 6', 7', are fixed to the cabin 1 whereas the other two groups 8, 8' and 9, 9' are fixed to the guide elements.

The groups 8 and 8' are fixed to the bottom portion of the guide elements 2 and 3 respectively, and the groups 9, 9' are fixed to the top portion of said guide elements 2 and 3.

In the example of FIG. 1 each group of pulleys is composed of two pulleys. Groups 6 to 9 are composed of pulleys 6*a*, 6*b*; 7*a*, 7*b*; 8*a*, 8*b*; 9*a*, 9*b*. Groups 6' to 9' are composed of pulleys 6'*a*, 6'*b*; 7'*a*, 7*b*; 8'*a*, 8'*b*; 9'*a*, 9'*b*.

The axes of pulleys of each group are mutually parallel and are superimposed in vertical direction one above the other. The reduction factor of the lifting power obtained in the pulley arrangement of FIG. 1 is equal to 4.

The pulleys of groups 6-9 and 6'-9' are arranged coplanar, and furthermore the two pulleys of each group are of a diameter decreasing from pulleys of a maximum diameter 6*a*, 7*a*, 8*a*, 9*a* and 6'*a*, 7'*a*, 8'*a*, 9'*a* respectively, to pulleys of a smaller diameter 6*b*, 7*b*, 8*b*, 9*b*, and 6'*b*, 7'*b*, 8'*b*, 9'*b*.

FIG. 1 relates to an embodiment where the belts 4, 5 are flat belts, and all the pulleys of groups 6 to 9 and 6' to 9' are provided with a groove for flat belts.

Movement of the cabin 1 can be effected in various modes: for example a motor, or a motor with reduction gear, rotates any one of the pulleys of one of the groups of pulleys for one belt. Referring to FIG. 1, a motor 10 drives via a connecting axle 17 the pulleys 8*a* and 8'*a*. The pulley 8*a* drives the belt 4 and the pulley 8'*a* drives the opposite belt 5.

The two support belts 4, 5, according to embodiments of the invention, are symmetrically arranged on one of the lateral walls 11, 12 or of the back wall 13 of the cabin 1.

Figure 2:
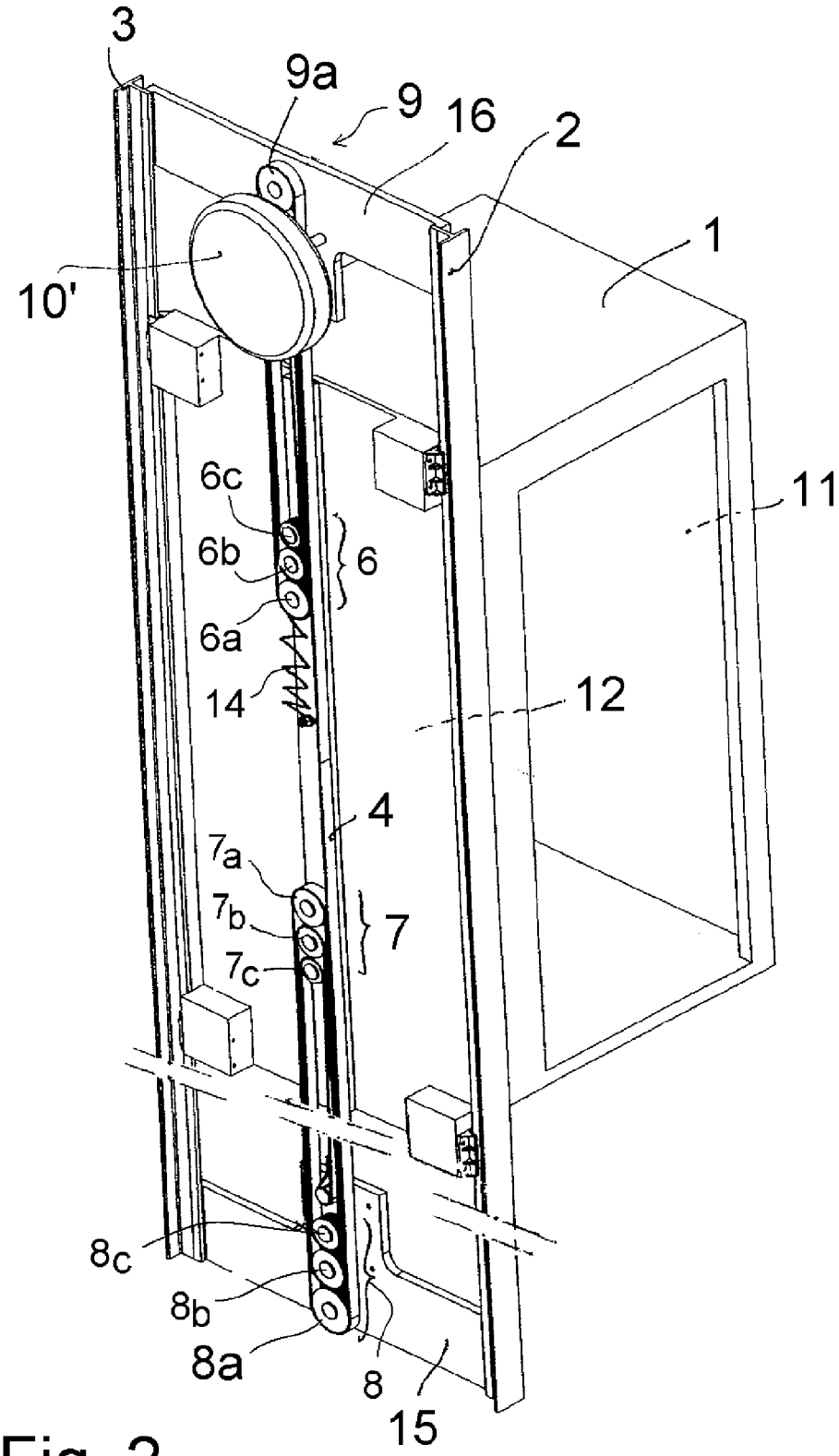
FIG. 2 is an alternative embodiment of the invention with one single belt at the middle portion of a lateral wall of the cabin.

The belts 4 and 5 are held under tension with the help of a suitable tension or compensation mechanism, for example a spring 14 as shown in FIG. 2, taking care of the variations of support belt lengths and securing sufficient friction between the belts 4, 5 and the respective drive pulleys 8*a* and 8'*a*. Said compensation mechanism, such as the spring 14, is known in the art and thus not to be described in more detail here.

The location of the groups of pulleys 6, 7, 6' and 7' is chosen in such a manner that the cabin 1 can move down as far as possible, i.e. to just above the drive motor 10, and upward as high as possible. In this arrangement the group of pulleys 8, 8', and 9, 9' respectively, can be "stacked" one above the other without colliding with the groups of pulleys 6, 6', and 7, 7' respectively. Thus the full length of the guide elements 2 and 3 can be exploited.

The arrangement of the guide elements 2, 3 must take into account the position of the access openings of the cabin 1. If the back wall 13 contains a door, it is not possible to provide a guide element corresponding with this wall. For this reason, arrangement of the guide elements 2, 3 corresponding with the lateral walls 11, 12 is generally preferred.

The pulleys of groups 6, 7 and 6', 7' are fixed to the cabin 1. As the cabin 1 moves upward from the bottom, the distance f between the group of pulleys 7, 7' and 8, 8' increases, whereas the distance F between the group of pulleys 6, 6' and 9, 9' decreases, and vice versa when the cabin 1 moves downwards.

FIG. 2 is an example of an alternative embodiment in which only one support belt 4 is applied in the symmetry plane of one of the lateral walls, for example the wall 12, or the back wall 13.

In this example the groups of pulleys 6, 7, 8 and 9 each comprises three coplanar pulleys 6*a*, 6*b*, 6*c*; 7*a*, 7*b*, 7*c*; 8*a*, 8*b*, 8*c*; 9*a*, 9*b*, 9*c*. The diameter of said pulleys decreases from –a through –c. For example, the first pulley 6*a* of group 6 has a diameter greater than that of the second pulley 6*b*, and pulley 6*b* has a diameter greater than the third pulley 6*c*. The reduction factor of the lifting power obtained in the three-pulley arrangement of FIG. 2 is equal to 6.

The groups 6 and 7 are fixed to the wall 12 of the cabin 1, whereas the groups 8 and 9 are fixed, with the help of the cross members 15 and 16, to the guide elements 2 and 3 of the cabin 1.

Figure 3:
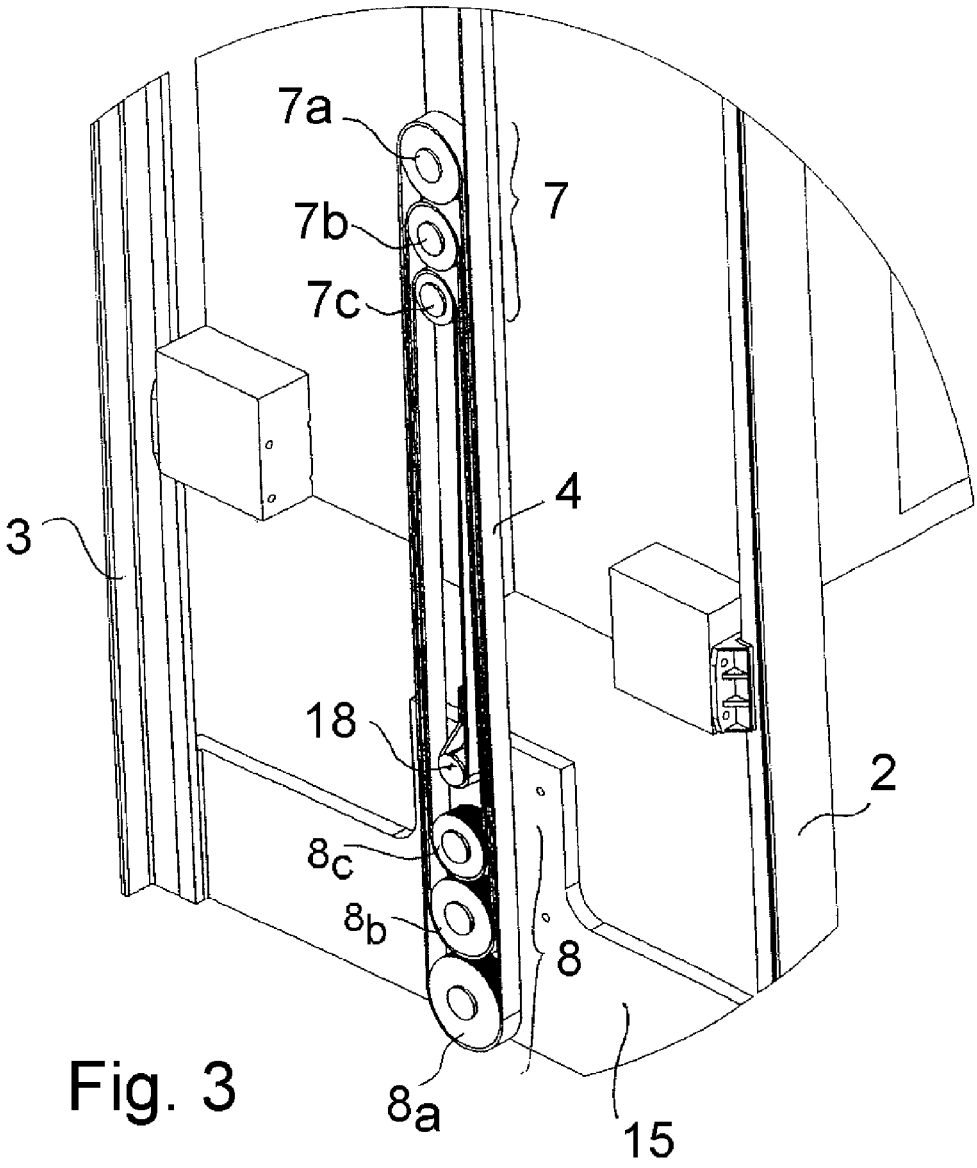
FIG. 3 is a detail of the lower portion of the cabin of the elevator of FIG. 2, the cabin being located near its lowest point.

In the FIG. 3 a detail is shown at enlarged scale of the lower portion of the FIG. 2, illustrating a preferred embodiment of fixing the end of the belts. In the example, the lower end of the belt 4 is fastened to a fixation pin 18 connected to the cross member 15. Said pin 18, in a preferred embodiment, is elastically connected to said cross member 15, being part of the tensioning mechanism for the belt 4, together with the elastic member 14.

According to a preferred embodiment, the drive motor 10 is a motor with an inner stator and a rotor forming a sleeve extending over at least part of a distance h between the two pulleys 8*a* and 8'*a* mutually connected for rotation. This solution has the advantage that motors of a minimum diameter can be applied, and thus the space in vertical direction can be fully used, e.g. allowing descent of the cabin to a lower level or to move up to a higher level. The example illustrated in the FIGS. 1 through 4 shows the motion of the belts 4 and 5. Generally speaking each of the pairs of pulleys at the same level can be connected to a motor such as the motor 10 and be used as drive pulley for the corresponding belt.

According to another embodiment, illustrated in the FIG. 2, the driving pulley is driven by a disk-type motor or a motor with permanent magnets 10', which is per se known. The advantage of said motor is the reduction of the total width, permitting to install the motor 10' essentially within the width of the guide elements 2 and 3. This advantage is important, in particular, in a layout of an elevator without a counterweight with only one single support belt as in FIG. 2.

As specified already, the present invention, and the particular arrangement of the pulleys provided therewith, illustrated in the FIG. 3 at an enlarged scale, generally can be applied also in elevators with a counterweight. For example, the groups of pulleys 7 and 8 are firmly connected to the cabin 1, whereas the other two groups 6 and 9 are connected to the counterweight.

Figure 4:
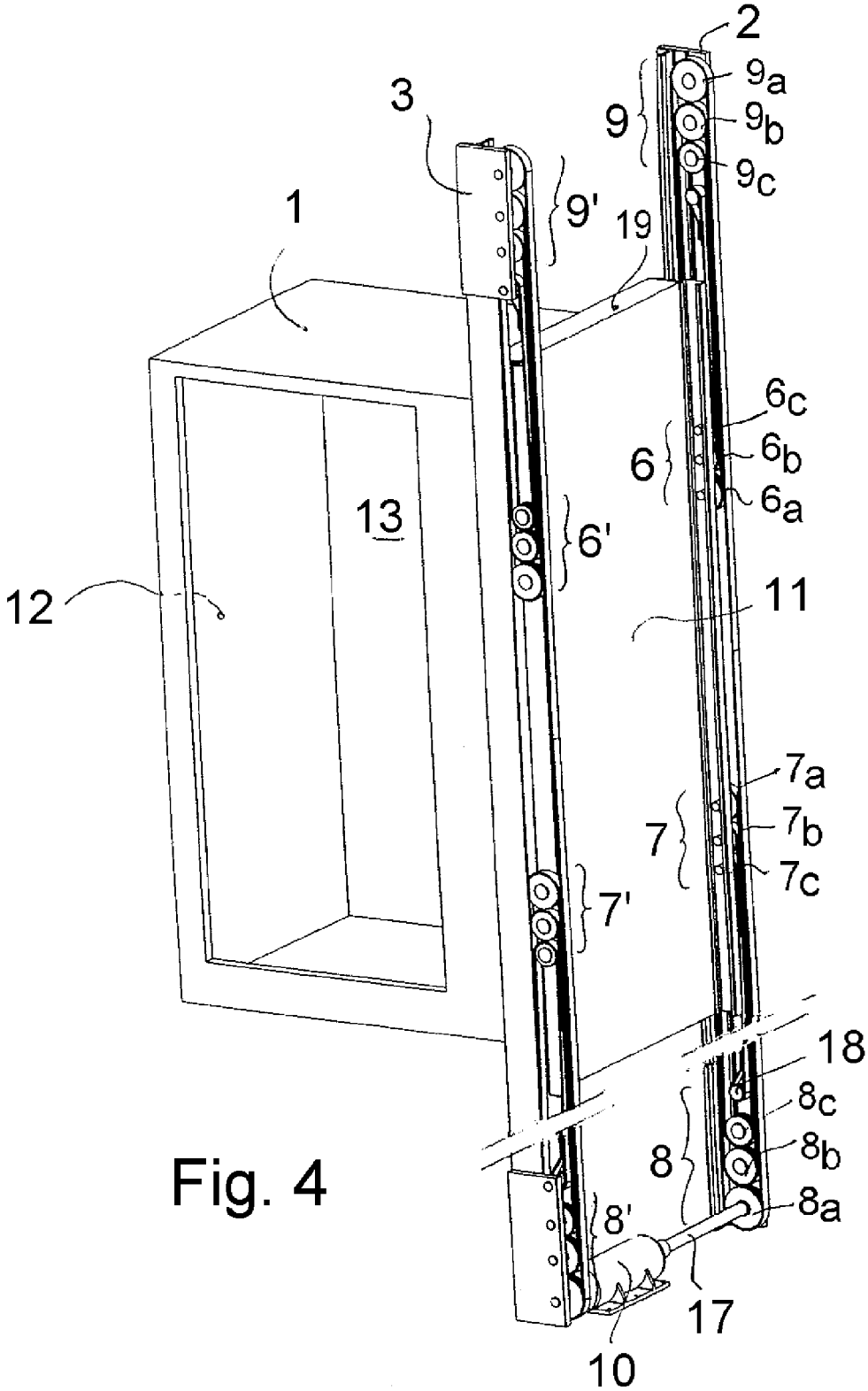
FIG. 4 is a sketch of an elevator according to a further embodiment, with two supporting belts located at the sides of one of the lateral side walls of the cabin.

In the FIG. 4 a further realisation variant is shown of the inventive elevator, of the type without counterweight, and equipped with two support belts.

The elements corresponding to the ones shown in the preceding Figures are designated using the same reference numbers. In this further embodiment, the guide elements 2 and 3 are located at both sides of one of the lateral walls 11 or 12 of the cabin 1, in the specific case illustrated being the wall 11, in such a manner that the cabin 1 is suspended on the guide elements 2 and 3. The drive power is reduced by a factor 6. This solution furthermore provides that the cabin 1 is fixed to a supporting plate 19, which can prove advantageous particularly in the case of restructuration of an existing building, as it permits realisation of a "cantilevered" cabin 1.

The factor of power reduction and thus of the friction required between the drive pulley and the belt, can be increased to 8 or more by increasing the number of pulleys in each group. For example, four pulleys per group gives a factor equal to 8, six pulleys per group gives a factor equal to 12, etc. Experience has shown that a reduction of driving power by a factor of four or six is normally sufficient.

Figure 5:
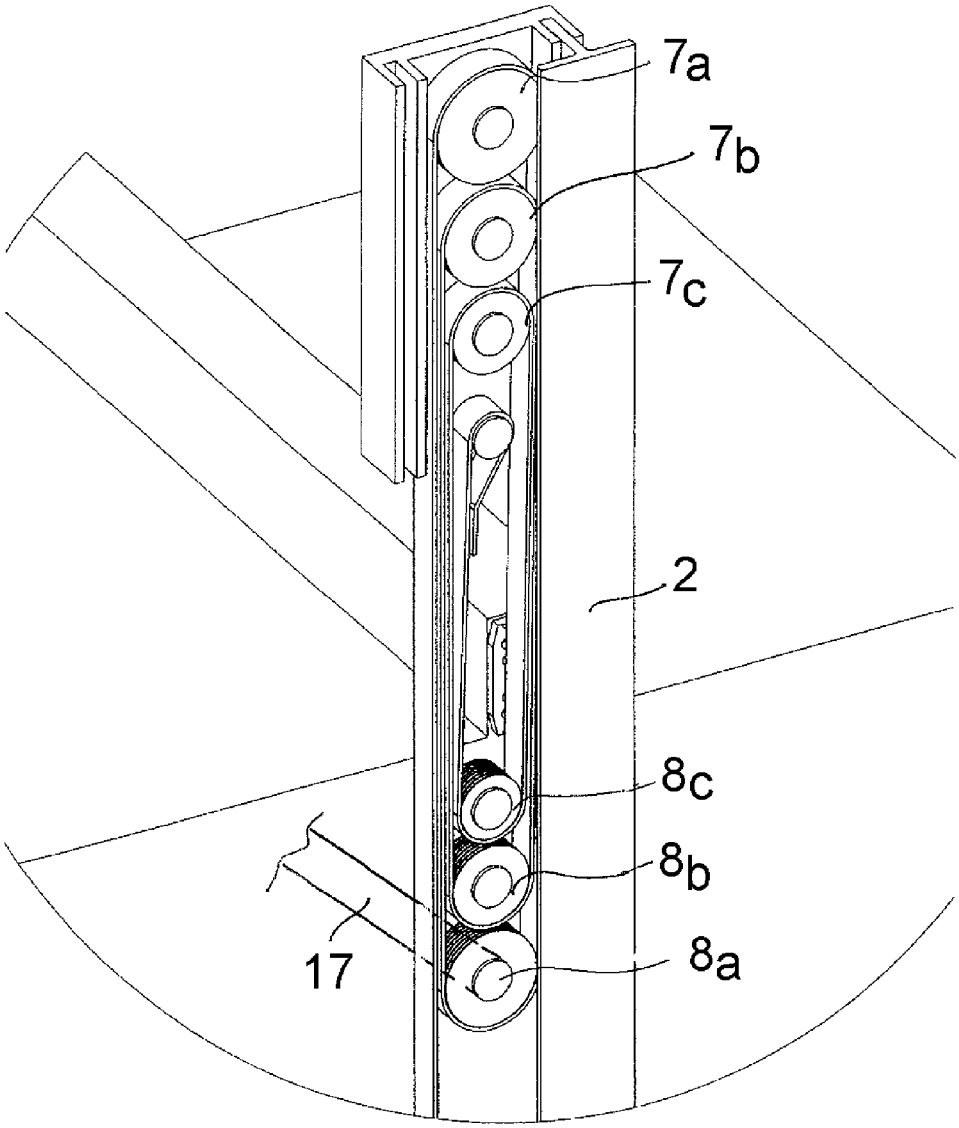
FIG. 5 is a detail of the FIG. 4, showing the possibility of equipping the grooves of the pulleys with means adapted to increase the belt friction.

Anyhow, in case a power reduction by a factor of six (three pulleys per group) might be required in a particular case as shown in the FIG. 5, it also could be provided that, according to a further preferred variant of realisation of the present invention, at least one pulley of one of the groups of pulleys 6, 7, 8, 9 functions as a drive pulley. For example the pulley 8*a* in the solution according to the FIGS. 1 and 4, and the pulley 9*c* in the solution according to the FIG. 2 is a drive pulley. Drive pulleys are preferably provided with means adapted to increase the friction between the pulley (e.g. 8*a* or 9*c*) and the support belt 4 or 5. Such means can be roughed-up surfaces of the pulley grooves achieved by applying suitable peripheral or transverse corrugations or ribs (parallel to the rotational axis, protrusions, etc.). Such means of course are particularly useful where the friction between the drive pulley and the support belt is most important, namely in the case of elevators without a counterweight.

FIGS. 6 to 11 relate to a further embodiment of the invention where the suspension or support means of the cabin is a belt having an arcuate cross section.

A belt 101 has a convex surface 102 parallel to an opposite concave surface 103, and lateral faces 104, 105. The belt 101 is reinforced with steel wires 107, 107' . . . 107$^{n}$ to increase the resistance to traction stress. Preferably said wires have a diameter of 1 to 3 mm. The wires are arranged parallel to the surfaces 102 and 103 and following the arc of the belt 101, as can be appreciated from FIGS. 6 and 8.

Figure 6:
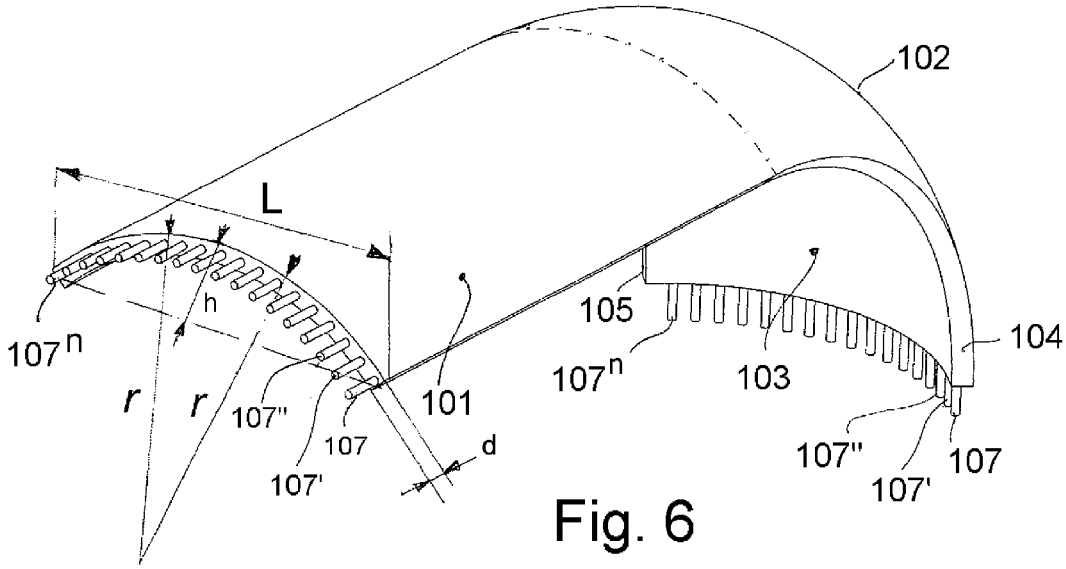
FIGS. 6 to 9 show preferred embodiments of belts and pulleys of the elevator.

The belt 101 is preferably thin and wide. To this purpose, the thickness d is at least 8 times smaller than the width L, i.e. L/d is equal to or greater than 8. The radius r is preferably such as the ratio between L and the height h in FIG. 6 is in the range 4 to 8.

Figure 7:
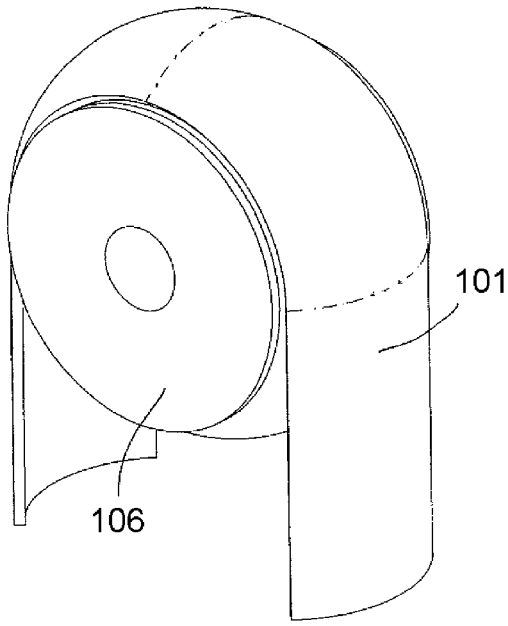
Figure 9:
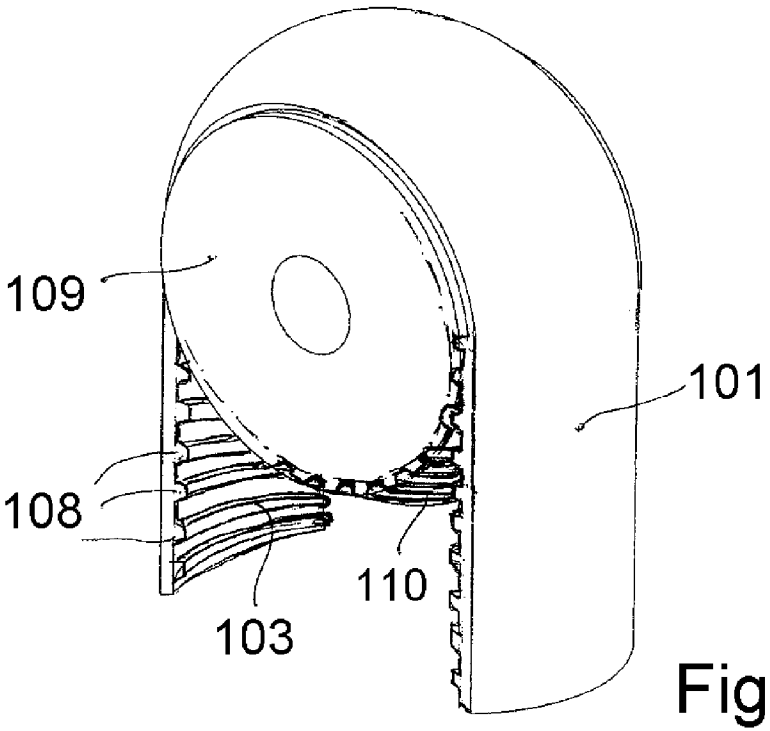
Figure 8:
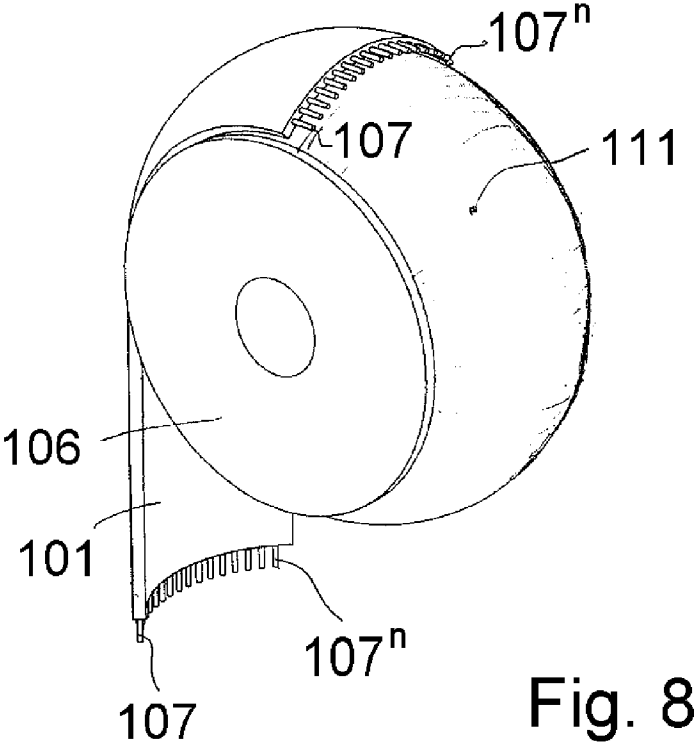

One of the faces 102, 103 is in contact, during operation, with the pulleys. The belt 101 passing around a pulley 106 is shown in FIG. 7. A pulley adapted for the belt 101 has a convex or concave surface to engage the concave or convex face of the belt, respectively. Referring for example to FIG. 8, the pulley 106 has a convex contact surface 111 to engage the concave surface 103 of the belt 101.

In a further variant (FIG. 9) the belt 101 has teeth 108 on the working surface 103 and a pulley 109 has corresponding teeth 110 to engage the toothed belt. Further means to improve the friction such as peripheral or transverse corrugations or ribs, as disclosed above, can be adopted also in this embodiment.

Figure 11:
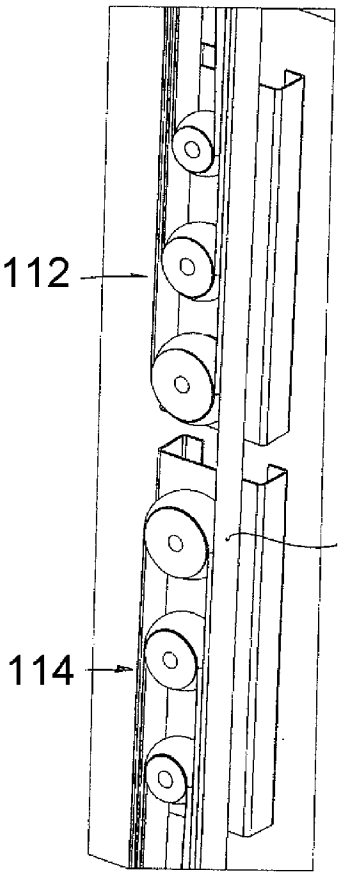
FIGS. 10 and 11 show an elevator comprising the belt of FIG. 6 to drive the cabin.
Figure 10:
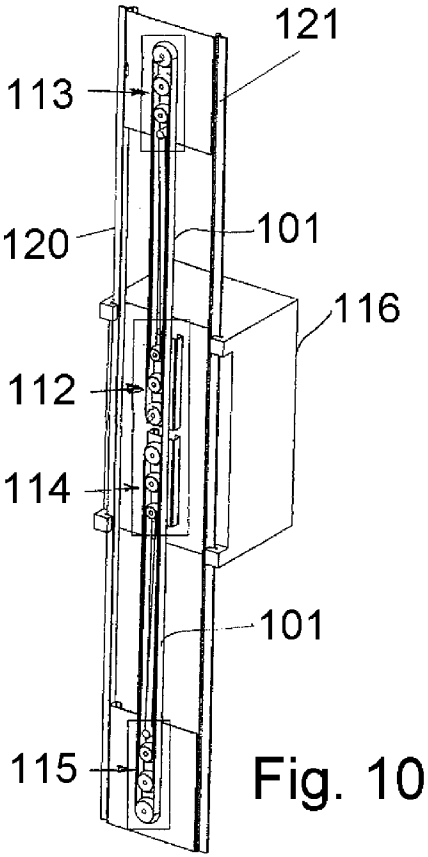
Figure 12:
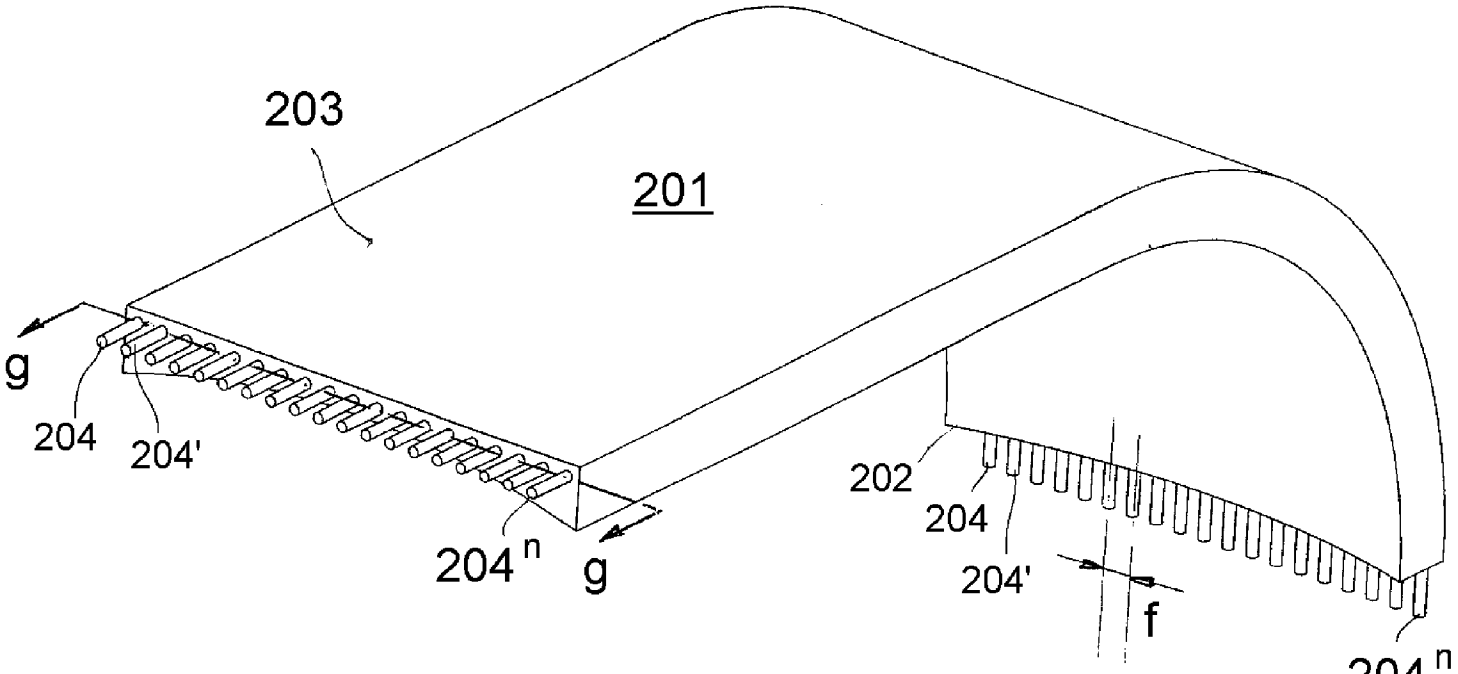
FIGS. 12 to 15 show another preferred embodiments of belts and pulleys of the elevator.
Figure 14:
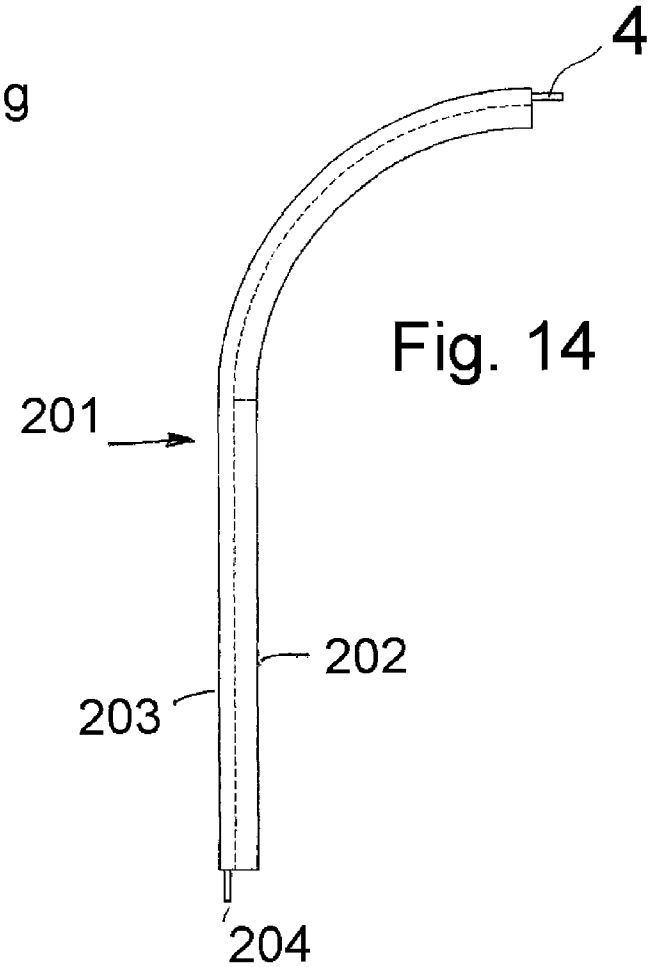

FIGS. 10 and 11 show the application of the arcuate belt 101 to an elevator according to the present invention, with groups 112, 113, 114 and 115 of pulleys, arranged for driving a cabin 116. Groups 112 and 114 are associated with the cabin 116 and groups 113, 115 are fixed to the guide rails 120, 121.

The belt according to this embodiment of the invention, such as the belt 101, is self-centering on the pulleys. For example, it can be seen from FIG. 8 that the belt 101 has a self-centering capability on the pulley 106, thanks to the matching between surfaces 103 and 111.

Hence, the pulleys do not require guiding edges that may cause wear of the lateral edges of a conventional belt. Another advantage is the improved adherence to the pulley and the constant contact pressure, which is more uniform than a flat belt. Hence, a greater torque can be transmitted from the pulley to the belt, in comparison with a flat belt. The inventive arcuate belt has a longer life than a conventional belt and do not require any lateral guide edge.

In a preferred embodiment, the concave or convex contact surface of the pulley is shaped to induce a slight deformation of arcuate cross section of the belt, during operation. Specific means to improve the friction, such as the teeth 108 and 110, are preferably adopted for driving pulleys and belts, i.e. for the pulley and belts that transmit a torque during operation.

FIGS. 12 to 16 relate to another embodiment of the invention, where the belt has a non-working flat surface and an opposite concave or convex working surface. The working surface is actually in contact with the pulleys during operation; the pulleys have a contact surface with a corresponding convex or concave surface respectively, to engage the working surface of the belt.

Referring to the figures, a belt 201 has a working surface 202 opposite to a non-working flat surface 203. The working surface 202 may be convex or concave, according to equivalent embodiments.

The belt 201 is optionally reinforced with highly resistant wires 204 to 204$^n$ which are disposed in a plane g-g parallel to the non-working plane surface 203.

Figure 13:
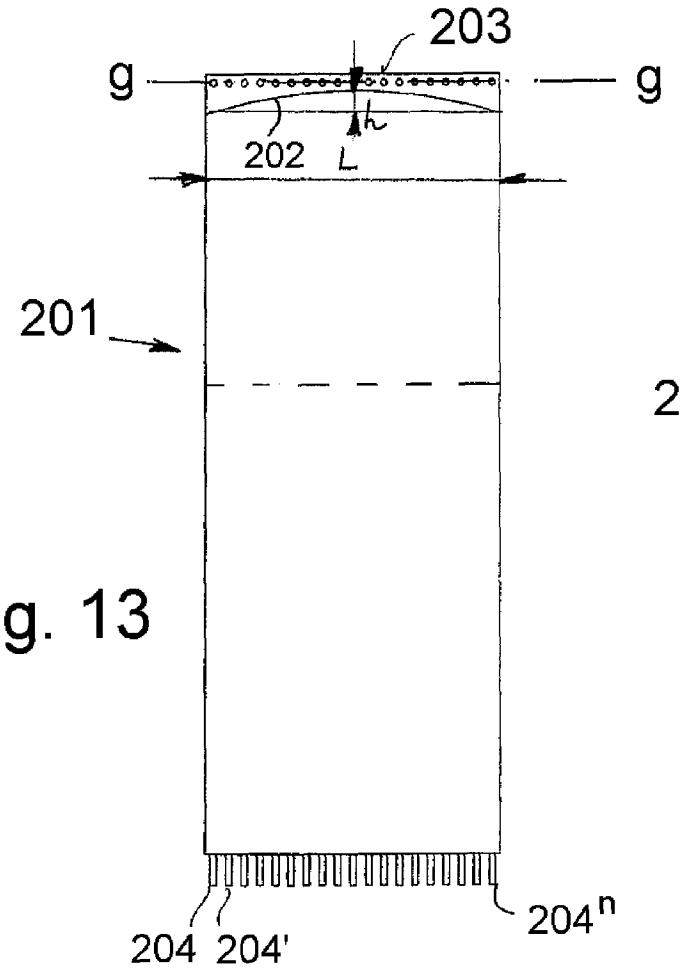

Referring to FIG. 13, the ratio between the width L of the belt 201 and height h of the arc formed by the concave working surface 202 is between 20 and 2000 and preferably in the range 500 to 1000. The same applies to embodiments with a convex working surface.

Preferred features of the belt 201 are the following. The wires 204 to 204$^n$ are preferably steel wires having a diameter between 0.5 and 2 mm, the distance f between two of said wires being preferably 1.5 to 5 mm and more preferably 2 to 3 mm. In a particularly preferred embodiment, the width L is between 20 and 100 mm and more preferably in the range 30 to 70 mm, especially for use in an elevator without counterweight.

Figure 15:
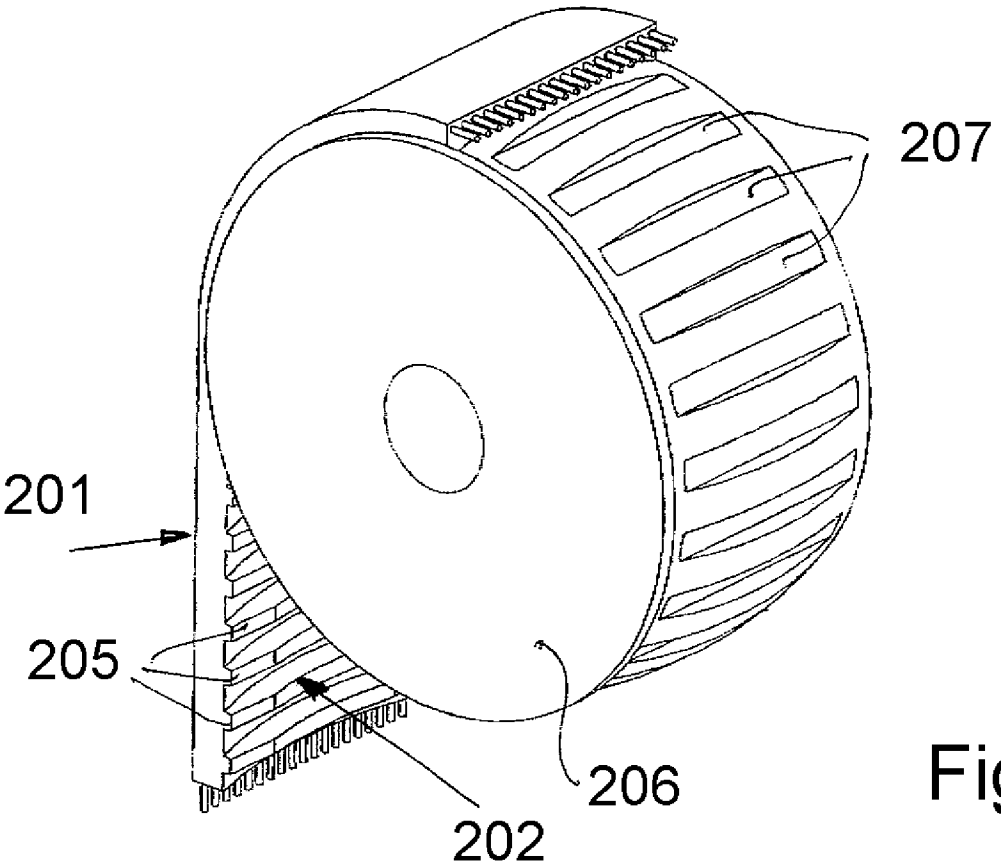

Measures to increase the friction between the belt and the pulley, such as teeth 205 and 207 (FIG. 15) can be adopted also in this embodiment. In particular, FIG. 15 shows a pulley 206 with teeth 207 adapted to engage teeth 205 of the working surface 202 of the belt 201.

The further realization according to FIGS. 12 to 16 has substantially the same functional advantageous features of the fully arcuate belt of FIGS. 6 to 11 including the self-centering capability and improved adhesion to the pulley. An additional advantage of this embodiment is that the manufacturing process is easier and less expensive due to the reinforcing wires being disposed in a plane parallel to the flat non-working surface, rather than in a curved arrangement. The positioning of the reinforcement wires during the manufacturing process is made simpler. For example, a process for manufacturing the belt 201 comprises the steps of: arranging the reinforcing wires 204 to 204$^n$ in the plane g-g, at a mutual distance of f, and moulding the belt 201 e.g. by injecting molten plastic material. Moreover, less plastic material is necessary because the thickness is not constant, but is reduced in the middle of the belt.

Another advantage is that the reinforcing wires are stressed with a "pure" traction stress, i.e. the flexional stress is reduced.

Figure 16:
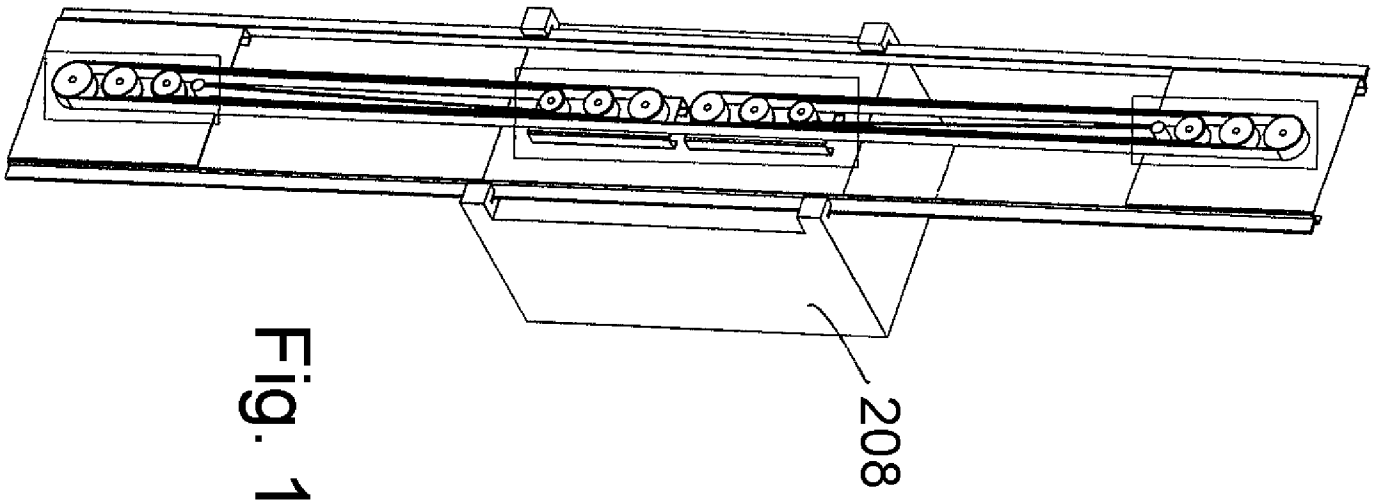
FIG. 16 shows an elevator comprising the belt of FIG. 12 to drive the cabin.

FIG. 16 discloses the use of the belt 201 in an elevator with a cabin 208, which is similar to the above described embodiments.

The invention claimed is:

1. An elevator comprising: a cabin with a top and a bottom including at least two side walls and a back wall disposed between said top and said bottom; vertical guide elements for guiding said cabin, said vertical guide elements each defining a length extending between oppositely disposed ends; two support belts arranged symmetrically on one of said side walls or said back wall of said cabin; each of said belts passing around a respective plurality of groups of pulleys disposed between said oppositely disposed ends, comprising fixed groups of stationary pulleys mounted to said length of said vertical guide elements, and a number of moving groups of travelling pulleys corresponding to said fixed groups of stationary pulleys where said moving groups of travelling pulleys are mounted to the cabin between said top and said bottom of said cabin, wherein each of said groups of pulleys comprises at least two pulleys, where said groups of pulleys are arranged on mutually parallel axles and where said groups of pulleys arranged on said mutually parallel axles are further arranged vertically parallel one above the other, said pulleys of each of said groups of pulleys are substantially coplanar, said fixed groups of stationary pulleys being mounted at a position proximal to both of said oppositely disposed ends of each of said vertical guide elements, and each of said groups of pulleys comprises at least two pulleys having a diameter progressively decreasing from a first pulley of said group having a maximum diameter, to a last pulley of said group having a minimum diameter, wherein one of said pulleys in two of said groups of pulleys is a drive pulley connected to a motor or a motor with a reduction gear, wherein each of said belts passing around each group of pulleys are co-planar and extend in substantially the same vertical direction of said pulleys in said group thereby minimizing lateral deviation during use of said elevator.

2. The elevator according to claim 1, comprising a single suspension belt arranged in a symmetry plane of one of the lateral walls or back wall of the cabin.

3. The elevator according to claim 1, wherein each of said groups of pulleys are composed of at least three pulleys having a diameter decreasing from a pulley of maximum diameter to a pulley of minimum diameter.

4. The elevator according to claim 1, wherein a drive pulley of one of said groups of pulleys acting on one of said two belts is connected solidly for rotation with a corresponding driving pulley of one group acting on the other belt, arranged at the same height, said drive pulleys being connected by a horizontal axle set into rotation by said motor, said motor being disposed intermediate said vertical guide elements.

5. The elevator according to claim 4, wherein said motor is a motor with an internal stator and a rotor which forms a sleeve extending over at least part of a distance between said two drive pulleys.

6. The elevator according to claim 4, wherein said vertical guide elements define a space intermediate and perpendicular to said vertical guide elements, said motor extending along said space defined by said vertical guide elements.

7. The elevator according to claim 1, wherein a drive pulley is driven by a disc type motor with permanent magnets.

8. The elevator according to claim 1, wherein the elevator is not provided with a counterweight, and is equipped with a tensioning mechanism, or compensation device for compensating length variations of the support belt(s), said device being capable of securing friction required between the belt(s) and the drive pulley(s).

9. The elevator according to claim 1, wherein each pulley of said groups of pulleys functioning as a drive pulley is provided on a groove surface with means adapted to increase friction between said pulley and said support belt.

10. The elevator according to claim 1, each suspension or support belt is moving around four groups of pulleys, at least one of said pulleys being fixed to the cabin and two of said pulleys being connected to said guide elements of said cabin.

11. The elevator according to claim 10, wherein said belt has a plurality of internal reinforcing wires which are highly resistant to traction, said reinforcing wires being arranged on a plane parallel to said flat surface of said belt, and wherein said reinforcing wires are steel wires having a diameter between 0.5 and 3 mm.

12. The elevator according to claim 11, wherein said reinforcing wires are distanced from each other by 1.5 to 5 mm.

13. The elevator according to claim 11, wherein said reinforcing wires are distanced each from other by 2 to 3 mm.

14. The elevator according to claim 1, wherein each suspension or support belt is a flat belt, and said pulleys having a groove for said flat belt.

15. The elevator according to claim 14, wherein each of said belts is a toothed belt and at least one of said pulleys comprising corresponding teeth to engage said toothed belt.

16. The elevator according to claim 1, wherein said at least one suspension or support belt is a belt with an arcuate cross-section, having a concave face and an opposite convex face, one of said concave and convex face being in contact with said pulleys, the pulleys having a contact surface with a corresponding convex or concave surface to engage the concave or convex face of the belt respectively.

17. The elevator according to claim 16, wherein said concave face and the opposite convex face of the belt are parallel.

18. The elevator according to claim 17, wherein said belt has a plurality of internal reinforcing wires which are highly resistant to traction, the reinforcing wires being arranged on an arcuate surface parallel to said concave and convex faces.

19. The elevator according to claim 16, wherein said belt has an overall width and forms an arc with a height, a ratio between the width and the height being in a range 4 to 8, a thickness of the belt being ⅛ or less of said overall width.

20. The elevator according to claim 1, wherein said at least one suspension or support belt being a belt with a flat surface and an opposite concave or convex working surface, said working surface being in contact with said pulleys during operation, the pulleys having a contact surface with a corresponding convex or concave surface respectively, to engage the working surface of said belt.

21. The elevator according to claim 20, wherein said belt has a plurality of internal reinforcing wires which are highly resistant to traction, the reinforcing wires being arranged on a plane parallel to said flat surface of the belt.

22. The elevator according to claim 20, wherein a ratio between a width of the belt and a height of an arc formed by the working surface is between 20 and 2000.

23. The elevator according to claim 22, wherein the ratio between the width of the belt and height of the arc formed by the working surface is in the range 500 to 1000.

24. The elevator according to claim 1, wherein said vertical guide elements are arranged symmetrically to one of said side walls of said cabin whereby said plurality of pulleys have an axis of rotation perpendicular to said side wall or are arranged symmetrically to said back wall of said cabin whereby said plurality of pulleys have an axis of rotation perpendicular to said back wall.

25. The elevator according to claim 1, wherein said moving groups of travelling pulleys are disposed intermediate said fixed groups of stationary pulleys mounted proximal to both oppositely disposed ends of each of said vertical guide elements.

* * * * *